US009942670B2

(12) United States Patent
Dickel et al.

(10) Patent No.: US 9,942,670 B2
(45) Date of Patent: Apr. 10, 2018

(54) HEARING AID DEVICE AND METHOD FOR OPERATING THE HEARING AID DEVICE WITH A COMMUNICATION DEVICE

(71) Applicant: SIVANTOS PTE. LTD., Singapore (SG)

(72) Inventors: Thomas Dickel, Buttenheim (DE); Matthias Froehlich, Erlangen (DE); Uwe Harich, Vierkirchen (DE); Carlo Christian Weimer, Nuremberg (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/837,191

(22) Filed: Aug. 27, 2015

(65) Prior Publication Data

US 2016/0066105 A1 Mar. 3, 2016

(30) Foreign Application Priority Data

Aug. 27, 2014 (DE) ..... 10 2014 217 085

(51) Int. Cl.
*H04R 25/00* (2006.01)

(52) U.S. Cl.
CPC ..... *H04R 25/554* (2013.01); *H04R 25/50* (2013.01); *H04R 25/505* (2013.01); *H04R 25/558* (2013.01); *H04R 25/45* (2013.01); *H04R 2225/41* (2013.01); *H04R 2225/61* (2013.01)

(58) Field of Classification Search
USPC ..... 381/312, 315, 316, 320
See application file for complete search history.

(56) References Cited

U.S. PATENT DOCUMENTS

| | | | | |
|---|---|---|---|---|
| 7,092,512 | B2 | 8/2006 | Kato et al. | |
| 8,379,889 | B2 * | 2/2013 | Feilner | H04R 25/43 381/190 |
| 9,570,089 | B2 | 2/2017 | Bauer et al. | |
| 2002/0076073 | A1 | 6/2002 | Taenzer et al. | |
| 2007/0147641 | A1 * | 6/2007 | Platz | H04R 25/558 381/315 |
| 2009/0154742 | A1 * | 6/2009 | Rasmussen | H04R 25/43 381/312 |

(Continued)

FOREIGN PATENT DOCUMENTS

| | | |
|---|---|---|
| EP | 1496670 A1 | 1/2005 |
| EP | 2712211 A1 | 3/2014 |

(Continued)

*Primary Examiner* — Sunita Joshi
(74) *Attorney, Agent, or Firm* — Laurence A. Greenberg; Werner H. Stemer; Ralph E. Locher

(57) ABSTRACT

A method operates a system of a hearing aid device and a communication device. The hearing aid device has an acousto-electrical transducer, a signal processing device and an electro-acoustic transducer. The communication device has a controller and an electro-acoustic transducer. The method includes the steps of: receiving of an incoming call by the communication device, signaling of the incoming call by the communication device by a first acoustic signal via the electro-acoustic transducer, receiving of the first acoustic signal by the acousto-electrical transducer of the hearing aid device, identifying of the first acoustic signal and carrying out of a first change of adjustment on the hearing aid device when the first acoustic signal has been identified.

17 Claims, 2 Drawing Sheets

(56) References Cited

U.S. PATENT DOCUMENTS

| | | | | |
|---|---|---|---|---|
| 2010/0272298 | A1 | 10/2010 | Feilner et al. | |
| 2011/0085687 | A1 | 4/2011 | Edgar | |
| 2011/0249836 | A1 | 10/2011 | Solum et al. | |
| 2013/0178162 | A1* | 7/2013 | Neumeyer ..... | H04W 4/008<br>455/41.2 |
| 2015/0172835 | A1* | 6/2015 | Sacha ..... | H04R 25/558<br>381/315 |

FOREIGN PATENT DOCUMENTS

| | | | |
|---|---|---|---|
| WO | 2008031901 | A1 | 3/2008 |
| WO | 2014049455 | A1 | 4/2014 |

* cited by examiner

HEARING AID DEVICE AND METHOD FOR OPERATING THE HEARING AID DEVICE WITH A COMMUNICATION DEVICE

CROSS-REFERENCE TO RELATED APPLICATION

This application claims the priority, under 35 U.S.C. § 119, of German application DE 10 2014 217 085.0, filed Aug. 27, 2014; the prior application is herewith incorporated by reference in its entirety.

BACKGROUND OF THE INVENTION

Field of the Invention

The invention relates to a hearing aid device and to a method for operating the hearing aid device with a communication device. The hearing aid device has an acousto-electrical transducer, a signal processing device and an electro-acoustic transducer. The communication device has a controller and an electro-acoustic transducer.

Hearing aid devices are portable hearing devices which are used to supply those hard of hearing. In order to meet the numerous individual requirements, different configurations of hearing aid devices such as behind-the-ear hearing devices (BTE), receiver in the canal (RIC) and in-the-ear hearing devices (ITE), e.g. also Concha hearing devices or in-the-ear hearing devices (ITE, CIC) are provided. The hearing devices listed by way of example are worn on the outer ear or in the ear canal. In addition, bone conduction hearing aids, implantable or vibrotactile hearing aids are also available on the market. In this context, the damaged hearing is stimulated either mechanically or electrically.

In principle, hearing aid devices have as essential components an input transducer, an amplifier and an output transducer. As a rule, the input transducer is an acousto-electrical transducer, e.g. a microphone and/or an electromagnetic receiver, e.g. an induction coil. The output transducer is mostly implemented as electro-acoustic transducer, e.g. miniature loudspeaker, or as an electromechanical transducer, e.g. bone conduction receiver. The amplifier is usually integrated into a signal processing device. The energy is usually supplied by a battery or a chargeable accumulator.

Because of the limited space offered, hearing aid devices provide only few possibilities of mounting operating elements. At the same time, however, the number of adjustment options and variants is increasing due to the digitization and the functions which can be implemented by this means.

SUMMARY OF THE INVENTION

It is an object of the present invention, therefore, to provide a hearing aid device and a method for operating the hearing aid device which would simplify utilization.

The method according to the invention relates to a method for operating a system of a hearing aid device and a communication device. The hearing aid device has an acousto-electrical transducer, a signal processing device and an electro-acoustic transducer. The communication device has a controller and an electro-acoustic transducer.

In one step of the method according to the invention, the communication device receives an incoming call. In this context, receiving a call is understood to be signaling of an incoming telephone call to a telephone or mobile telephone in the traditional sense but also, in a more general sense, the incoming of a message which can be reproduced via an acoustic output.

In another step of the method according to the invention, the communication device signals the incoming call by a first acoustic signal via the electro-acoustic transducer. In this context, it is conceivable that the communication device outputs via the electro-acoustic transducer a single tone of a predetermined frequency, predetermined combinations or sequences of acoustic signals or also a predetermined first item of information modulated onto an acoustic carrier frequency as first acoustic signal.

In a further step of the method according to the invention, the hearing aid device receives the first acoustic signal by the acousto-electrical transducer so that it is available for further processing by the signal processing device.

In one step of the method according to the invention, the hearing aid device identifies the first acoustic signal. For this purpose, for example, the signal processing device can determine a correspondence with a predetermined pattern of frequency, pitch and temporal sequence for individual or combined acoustic signals and signal sequences. When a modulated item of information is applied, demodulation can also take place and the demodulated item of information compared with a predetermined item of information.

In another step of the method according to the invention, the hearing aid device carries out a first change of adjustment when the first acoustic signal has been identified. The change of adjustment can relate to a value of an individual adjustment or of an individual signal processing parameter but also to the change of an entire set of signal parameters in the sense of a change of hearing program. This also means that the hearing aid device changes, for example, into another operating state.

The method according to the invention advantageously enables the hearing aid device to be informed of an incoming call without requiring for this purpose other possibly additional energy-consuming signal transmission devices such as, e.g., Bluetooth. The hearing aid device is thus able to adjust itself to a reproduction of the incoming call or to prepare such an adjustment.

The hearing aid device according to the invention has an acousto-electrical transducer, a signal processing device, an electro-acoustic transducer and a device for detecting a distance of a communication device relative to the hearing aid device.

The hearing aid device is configured to receive a first acoustic signal through the acousto-electrical transducer and to identify the first acoustic signal. For this purpose, the signal processing device can be configured, for example, to determine a correspondence with a predetermined pattern of frequency, pitch and temporal sequence for individual or combined acoustic signals and signal sequences. When a modulated item of information is applied, demodulation can also take place and the demodulated item of information can be compared with a predetermined item of information. A separate identification device in the hearing aid device is also conceivable.

Furthermore, the hearing aid device is configured to carry out a first change of adjustment when the first acoustic signal is identified. It is conceivable that the signal processing device changes one or more parameters and/or the operating state of the hearing aid device, e.g. in that a different program is carried out.

In this context, the first change of adjustment specifies a change in the state of the hearing aid device into a first operating state, the hearing aid device being configured, in the first operating state, to monitor an environment of the hearing aid device for an approach of the communication device with the aid of the device for detecting a distance.

The hearing aid device according to the invention is advantageously able to provide the hearing aid device wearer due to the combination of an acoustic signal and the monitoring, triggered as a result, for detecting a physical approach to a communication device, with a reliably occurring response to an incoming call at the communication device.

Further advantageous developments of the invention are specified in the dependent claims.

In a conceivable embodiment of the method according to the invention, the communication device sends out the first acoustic signal when the incoming call is accepted on the communication device. In this context, "accepting" is also understood to mean that the hearing aid device wearer triggers an acoustic output in the case of a message which can be output acoustically.

In that the communication device sends out the first acoustic signal only when the hearing aid device wearer desires an acoustic output, it is ensured advantageously that a change in the hearing aid device is only triggered when the hearing aid device wearer also wishes to listen to the call or the message via the hearing aid device.

In one possible embodiment of the method according to the invention, the first acoustic signal is part of a ringing sound.

Ringing sounds signal an incoming call and are advantageously applicable on a multiplicity of different communication devices so that the hearing aid device wearer of the hearing aid device is not committed to a specific communication device for carrying out the method according to the invention.

In a conceivable embodiment of the method according to the invention, the hearing aid device also has a device for detecting a distance of the communication device relative to the hearing aid device, the first change of adjustment specifying a change in state of the hearing aid device into a first operating state and the hearing aid device, in the first operating state, monitors an environment of the hearing aid device for an approach to the communication device with the aid of the device for detecting a distance.

The method according to the invention is advantageously able to provide the wearer of the hearing aid device, due to the combination of an acoustic signal and the monitoring, triggered as a result, for detecting a physical approach to a communication device, with a reliably occurring response to an incoming call at the communication device.

In a further possible embodiment of the method according to the invention, the hearing aid device performs a second change of adjustment on detecting the approach of the communication device.

The change in the operating state can thus be isolated advantageously from a change acoustically perceptible by the wearer so that acoustic irritations are minimized for the wearer.

In a conceivable embodiment of the method according to the invention, the hearing aid device cancels the second change of adjustment or performs a third change of adjustment when the device for detecting a distance detects a removal of the communication device from the environment of the hearing aid device.

If the communication device is removed again from the hearing aid device, the hearing aid device wearer wishes for a temporary or permanent interruption of listening via the communication device. By recognizing the removal, the method according to the invention allows this wish to be recognized and can independently advantageously perform a corresponding change in the adjustments.

In one possible embodiment of the method according to the invention, the hearing aid device estimates a transfer function of a feedback path, for example as part of a method for feedback suppression, and utilizes a change of the transfer function as means for detecting a distance of the communication device relative to the hearing aid device. For example, proportions of the transfer function which can be allocated to a length of the feedback path between 5 cm and 20 cm or 10 cm and 30 cm are typical of an object such as a communication device in the vicinity of the ear and thus in the vicinity of the hearing aid device.

Many hearing aid devices already have feedback suppression and associated means for estimating a transfer function of a feedback path. By assessing the result, it is advantageously possible to detect an approach of the communication device relative to the hearing aid device without an additional device.

In one conceivable embodiment of the method according to the invention, the device for detecting a distance is a facility for detecting a distance signal of the communication device. Thus, it is possible, for example, that a smart phone recognizes, by way of its touch-sensitive surface, an approach to the ear, for example for automatically accepting a call. In this context, it is also possible that the smart phone or the communication device, respectively, transfers via an acoustic signal or another optical or electromagnetic signal an item of information relating to an approach to the ear and the hearing aid device is designed to receive this signal and to evaluate it, for example by a corresponding receiver.

This advantageously enables an approach of the communication device to the ear, thus to the hearing aid device, to be detected without a distance detector in the hearing aid device itself.

In one possible embodiment of the method according to the invention, the hearing aid device cancels the first change of adjustment or performs a fourth change of adjustment when a second acoustic signal is received from the communication device so that the hearing aid device leaves the first operating state.

Thus, the hearing aid device, advantageously controlled by the communication device can leave the first operating state again. For example, the communication device can report in this manner that the call or the message is ended and the hearing aid device can change back into an adjustment or an operating state which is suitable for another hearing situation.

In one possible embodiment, the hearing aid device is configured to perform a second change of adjustment on detection of the approach of the communication device.

In this context, it is advantageous if the hearing aid device isolates the change in the operating state from a change acoustically perceptible by the hearing aid device wearer and performs this change only on approach so that acoustic irritations are minimalized for the wearer.

In one conceivable embodiment of the hearing aid device according to the invention, the latter is configured to cancel the second change of adjustment or to perform a third change of adjustment when the device for detecting a distance detects a removal of the communication device from the environment of the hearing aid device.

If the communication device is removed again from the hearing aid device, the wearer wishes for a temporary or permanent interruption of listening via the communication device. By recognizing the removal, the hearing aid device according to the invention allows this wish and can independently advantageously perform a corresponding change in the adjustments.

In one possible embodiment of the hearing aid device, the latter has an estimating device for estimating a transfer function of a feedback path, for example as part of a device for feedback suppression, and utilizes a change of the transfer function as means for detecting a distance of the communication device relative to the hearing aid device. For example, proportions of the transfer function which can be allocated to a length of the feedback path between 5 cm and 20 cm or 10 cm and 30 cm are typical of an object such as a communication device in the vicinity of the ear and thus of the hearing aid device. The hearing aid device is configured to utilize in this or another manner a change of the estimated transfer function as means for detecting a distance.

Many hearing aid devices already have feedback suppression and associated means for estimating a transfer function of a feedback path. By assessing the result, it is advantageously possible to detect an approach of the communication device relative to the hearing aid device without an additional device.

In a conceivable embodiment of the hearing aid device according to the invention, the hearing aid device has as means for detecting a distance a facility for detecting a distance signal of the communication device. Thus, it is possible, for example, that a smart phone recognizes, by way of its touch-sensitive surface, an approach to the ear, for example for automatically accepting a call. In this context, it is also possible that the smart phone or the communication device, respectively, transfers via an acoustic signal or another optical or electromagnetic signal an item of information relating to an approach to the ear and the hearing aid device is designed to receive this signal and to evaluate it, for example by a corresponding receiver.

This advantageously enables the hearing aid device to detect an approach of the communication device to the ear, and thus to the hearing aid device, without having a distance detector itself.

In a further embodiment, the hearing aid device is configured to cancel the first change of adjustment or to perform a fourth change of adjustment when a second acoustic signal is received so that the hearing aid device leaves the first operating state.

Thus, the hearing aid device, advantageously controlled by the communication device, can leave the first operating state again. For example, the communication device can report in this manner that the call or the message is ended and the hearing aid device can change back into an adjustment or an operating state which is suitable for another hearing situation.

Other features which are considered as characteristic for the invention are set forth in the appended claims.

Although the invention is illustrated and described herein as embodied in a hearing aid device and a method for operating the hearing aid device with a communication device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
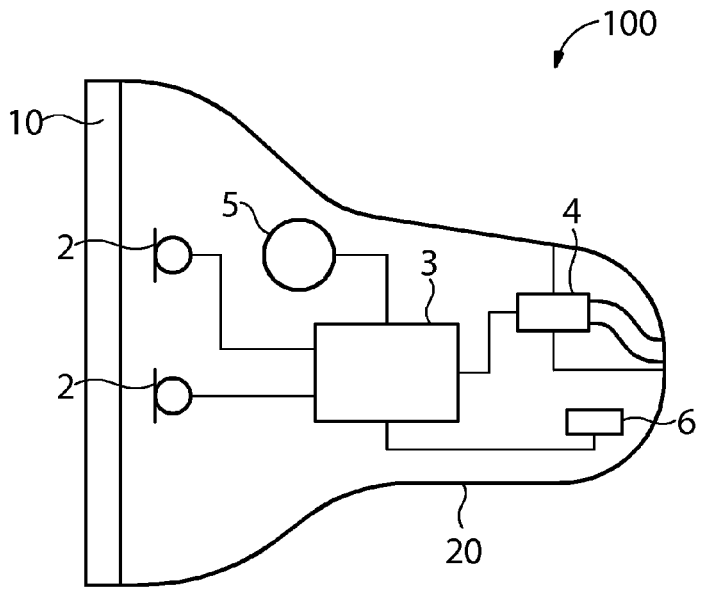
FIG. 1 is a diagrammatic illustration of a hearing aid device according to the invention.
Figure 2:
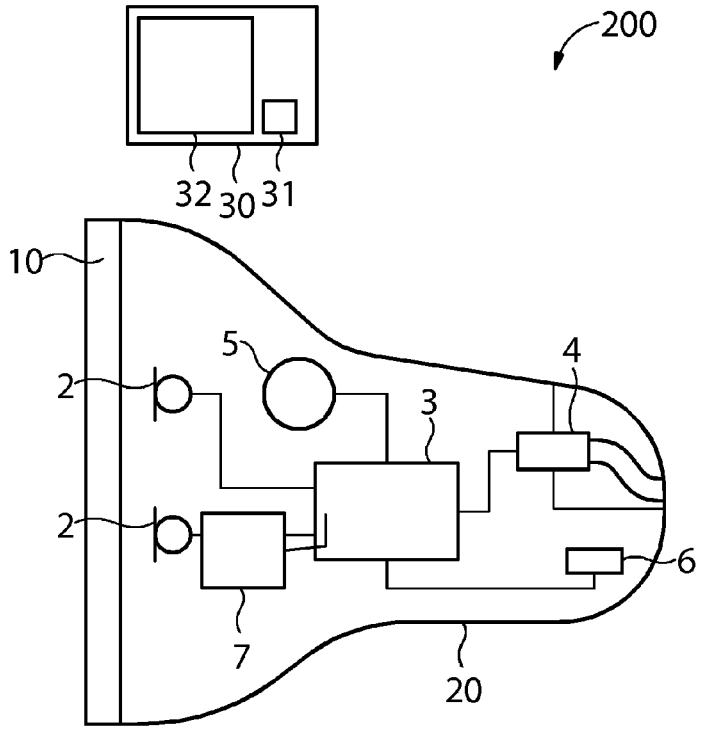
FIG. 2 is a diagrammatic illustration of a system according to the invention.

Referring now to the figures of the drawings in detail and first, particularly to FIG. 1 thereof, there is shown basic structure of a hearing aid device 100 according to the invention. FIG. 2 shows a system 200, according to the invention, including the hearing aid device 100 according to the invention, and a communication device 30. The same reference symbols designate the same objects as in FIG. 1. The hearing aid device 100 of FIG. 2 has a separate signal identification device 7.

Into a hearing aid device housing 10, 20, one or more microphones, also called acousto-electrical transducers 2, for receiving the sound or acoustic signals from the environment are installed. In principle, the hearing aid device can be a behind-the-ear (BTE) or in-the-ear (ITE). The microphones 2 are acousto-electrical transducers 2 for converting the sound into first electric audio signals. A signal processing device 3 which is also arranged in the hearing aid device housing 10, 20 processes the first audio signals. An output signal of the signal processing device 3 is transferred to a loudspeaker or receiver 4, respectively, which outputs an acoustic signal. In the case of a BTE hearing aid device, the sound is possibly transferred via an acoustic tube or external receiver, which is fixed in the ear canal with an otoplastic, to the ear drum of the device wearer. However, another electromechanical transducer is also conceivable such as, for example, a bone conduction receiver. The hearing aid device 100 and particularly the signal processing device 3 are supplied with energy by a battery 5 also integrated in the hearing aid device housing 10, 20.

The communication device 30 has a signal transmitter 31 for generating the predetermined acoustic signal. In the case of a smart phone, this can be a processor with a sound card and a loudspeaker but also a dedicated circuit with an electro-acoustic transducer.

In an application-oriented operation of the hearing aid device 100, the signal processing device 3 also processes first audio signals with the first acoustic signal. The signal processing device 3 is preferably configured, therefore, to identify the first acoustic signal. For this purpose, if the acoustic signal has tones or tone combinations, a filter can be provided in each case for each tone for an individual predetermined tone or a tone combination, which filter filters out the tone or the tones of the tone combination, and a logic which, upon transgression of an amplitude of the filtered signal or signals identifies the first acoustic signal. In this context, it is also conceivable that the signal processing device 3 filters the tone or tones or acoustic signals out of a signal forwarded to the receiver 4 of the hearing aid device in order not to irritate the wearer of the hearing aid device.

It is also conceivable that the acoustic signal or signals are outside a frequency range perceptible by the wearer, e.g. above 10 kHz.

It is also possible that the first acoustic signal contains a predetermined item of information modulated on to an acoustic carrier frequency. The hearing aid device 100 can then demodulate the first acoustic signal in the signal processor 3 or a separate signal identification device 7, and identify the predetermined item of information by comparing it with a stored value. There are many different methods which are conceivable as modulation methods such as, e.g., DTMF, QAM or other modulation methods.

It is conceivable in this context that the item of information has a hearing-aid-device-specific component, for example, a serial number, so that when a number of hearing aid device wearers are present, other communication devices 30 do not produce a disturbance.

The hearing aid device 100 also has an estimating device for estimating a transfer function of a feedback path. The estimating device is implemented in the signal processing device 3 but can also be provided as a separate unit. The estimating device in a hearing aid device 100 is usually used in this context for determining any feedback to be expected and to generate a corresponding signal which suppresses the feedback. However, the characteristics of a feedback path change greatly when an object such as a communication device is brought into the vicinity of the ear with the hearing aid device 100. For example, components which can be associated with a short feedback path having a length of 5 cm, 10 cm or 20 cm, that is to say have delay times within a range of from 0.1 ms to 1 ms, will then increase greatly. In this manner or another manner, the signal processing device 3 or the hearing aid device 100, respectively, can detect an approach of an object to the ear. Since the hearing aid device has already been placed into another operating state or an adjustment has been changed by the first acoustic signal, the coincidence of the two events enables the approach of a communication device to be distinguished from other approaches, for example of a hand or of a window pane in the car.

However, it is also conceivable that the hearing aid device has as means for detecting a distance, a facility for detecting a distance signal of the communication device. For this purpose, the hearing aid device 100 can have, for example, a first facility 6 for communication by means of alternating electromagnetic fields. The first facility 6 can be, for example, a transmitter, a receiver or also a transceiver for alternating electromagnetic fields. The transmission of item of information by means of the first facility 6 can take place, for example, in accordance with a standard such as Bluetooth, WLAN, Near Field Communication NFC or also a transmission method normally or proprietarily used in hearing device technology. By use of this facility 6, the hearing aid device 100 can receive a signal of the communication device 30. The facility 6 is preferably supplied with energy only after identification of the first acoustic signal in order to save the battery 5 of the hearing aid device 100.

If the communication device 30 is, for example, a smart phone, it can detect an approach of the smart phone to an ear of the user by its touch-sensitive operating surface 32 particularly if the position is also detected by position sensors. The smart phone can then, for example by use of an application, transmit the approach of the communication device 30 to the ear and the hearing aid device 100 by one of the transmission technologies to the facility 6 so that the hearing aid device 100 can detect an approach without providing a corresponding sensor itself. This also provides for a distinction of the communication device 30 from another object which approaches the ear.

In this context, the hearing aid device 100 is configured to perform a second change of adjustment on detection of the approach of the communication device 30. This is preferably a switching-over to a hearing program which is particularly suitable for reproducing a telephone call. The change can happen in that the signal processor 3 or another controller loads a different set of signal processing parameters into the signal processor 3 or causes it to execute another program code.

The hearing aid device 100 is preferably also configured to detect a removal of the communication device from the environment of the hearing aid device by way of the device for detecting a distance and to cancel the second change of adjustment or to perform a third change of adjustment. If the communication device 30 is removed again from the hearing aid device 100, the telephone call or the listening to the message is usually ended so that the wearer of the hearing aid device will want to use a hearing program again for another hearing situation. The signal processor 3 or the controller of the hearing aid device 100, respectively, then changes signal processing parameters or the program code executed again.

However, it is also conceivable that the hearing aid device is configured to receive and to identify a second acoustic signal in the manner as has already been described for the first acoustic signal, and then leaves the first operating state and/or cancels the first change of adjustment or performs a fourth change of adjustment. Finally, it is also conceivable that the facility 6 is utilized for signaling such a change to the hearing aid device 100.

Figure 3:
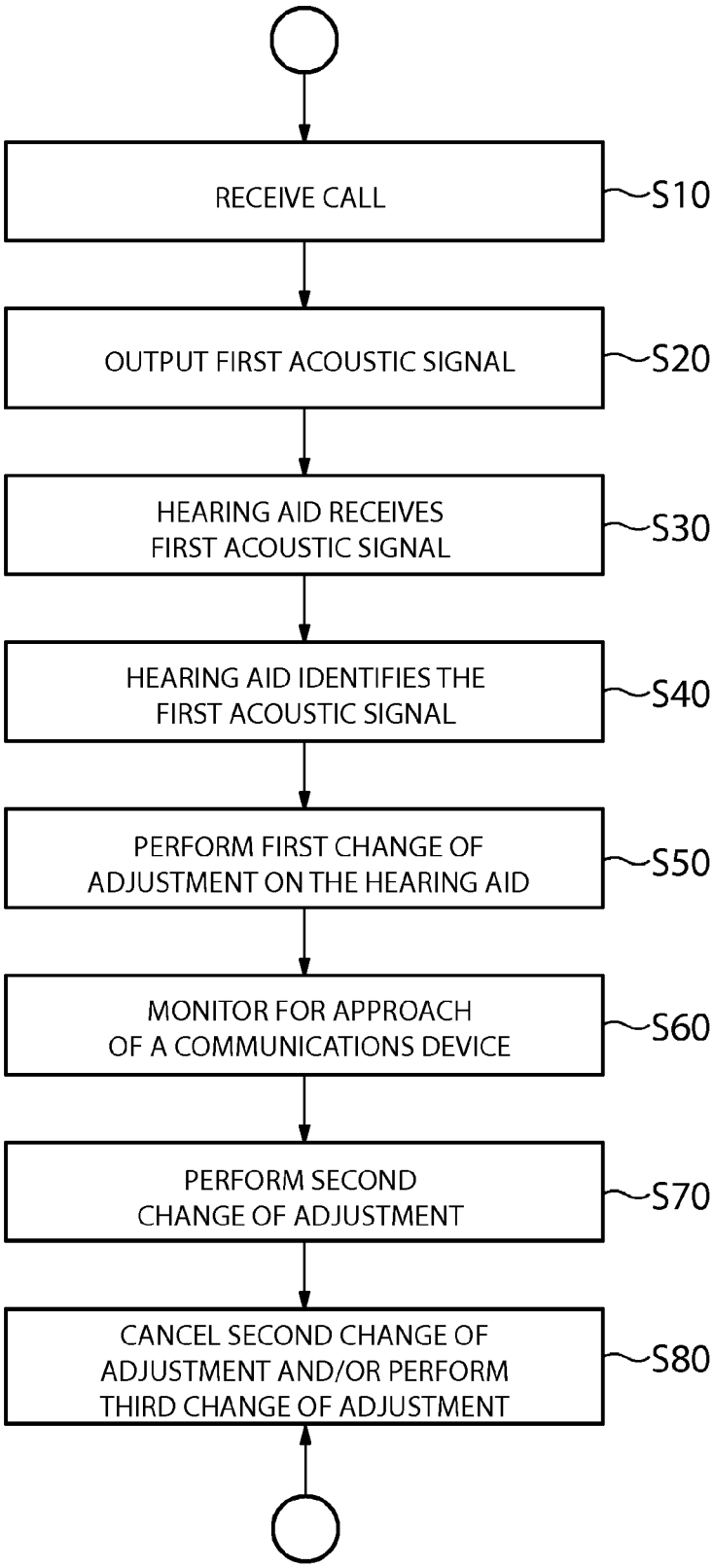
FIG. 3 is a flowchart of an embodiment of the method according to the invention.

FIG. 3 shows a diagrammatic flowchart of a method according to the invention.

In a step S10, the communication device 30 receives an incoming call. A call is understood to be any message which is suitable for acoustic output, for example a telephone call, an audio or video file, a readable text file or other item of information. Receiving can be considered to be the complete transmission of the message or also of only a part, or the announcement that the message is ready for transmission. The reception can take place, for example, wirelessly via a mobile data service, a wireless network or also in a wire-connected manner.

In a step S20, the communication device 30 signals the incoming call by means of a first acoustic signal via the electro-acoustic transducer 31. In this context, it is conceivable that the communication device 30 only sends out the first acoustic signal when the incoming call is accepted on the communication device 30.

In this context, accepting is understood to mean that the user of the communication device informs the communication device via an operating process or another gesture that he wishes to hear the message. It is conceivable that he operates an operating element on the communication device 30, inputs a command on an operating surface, informs the communication device of this by an acoustic command or a particular movement.

In a conceivable embodiment of the method according to the invention, the first acoustic signal is part of a ringing sound, wherein the part can also comprise the entire ringing sound. Ringing sounds are understood to be acoustically reproducible items of information which can be reproduced from a communication device 30 in order to signal an incoming call or message. Ringing sounds can be, for example, sound sequences or compressed or uncompressed files with acoustic signals.

In a step S30, the hearing aid device 100 receives the first acoustic signal via an acousto-electrical transducer 2 and forwards it as electrical signal to the signal processing device 3 or to a signal identification device 7.

In a further step S40, the hearing aid device 100 identifies the first acoustic signal. This can be carried out by the signal processing device 3 which recognizes individual acoustic signals or signal sequences by use of filters and logical combinations. The signal processing device 3 can also apply a demodulation method in order to obtain from the first acoustic signal an item of information modulated therein and to compare it with a predetermined item of information. In this context, it is conceivable that the item of information also has a part which is individual to each hearing aid device such as, e.g., a serial number. The identification of the first acoustic signal has taken place when a correspondence of the received first acoustic signal with a predetermined sound, sound sequence has been found or, respectively, a correspondence of the information transmitted with the first acoustic signal with a predetermined item of information.

In a further step S50, the hearing aid device 100 or a controller or the signal processing device 3 carries out a first change of adjustment on the hearing aid device 100 when the first acoustic signal has been identified. The first change of adjustment can be, for example, a change of an individual parameter or of a number of parameters in the signal processor 3, a change of the signal processor 3 or of the controller of the hearing aid device 100 to another program code or also a change in the state of a switch or of an electric value in the hearing aid device 100.

In one possible embodiment of the method according to the invention, the first change of adjustment specifies a change in the state of the hearing aid device into a first operating stage. In this context, the hearing aid device, in a step S60, monitors in the first operating state, with the aid of the means for detecting a distance, an environment of the hearing aid device for an approach of the communication device.

In a conceivable embodiment of the method according to the invention, the hearing aid device 100 or its signal processor 3, respectively, estimates as means for detecting a distance a transfer function of a feedback path.

Details are stated in the preceding description of FIGS. 1 and 2.

In another embodiment of the method according to the invention, the means or device for detecting a distance includes a facility 32 for detecting a distance signal of the communication device. In this context, the detection of the distance is carried out on the communication device 30 and the result is reported to the hearing aid device 100 via a facility 6 for communication.

In a conceivable embodiment of the method according to the invention, the hearing aid device performs a second change of adjustment in step S70 on detection of the approach of the communication device. The second change of adjustment preferably causes an improved rendition in a hearing situation "telephoning". The second change of adjustment can take place by a change of signal processing parameters in the signal processor 3 by the signal processor 3 or the controller of the hearing aid device 100.

In one conceivable embodiment of the method according to the invention, the hearing aid device cancels the second change of adjustment in a step S80 or performs a third change of adjustment when the device for detecting a distance detects a removal of the communication device 30 from the environment of the hearing aid device 100.

In one possible embodiment of step S80, the hearing aid device cancels the first change of adjustment or performs a fourth change of adjustment when a second acoustic signal is received from the communication device 30 so that the hearing aid device 100 leaves the first operating state.

Although the invention has been illustrated and described in greater detail by the preferred exemplary embodiment, the invention is not restricted by the examples disclosed and other variations can be derived from it by the expert without departing from the scope of the invention.

We claim:

1. A method for operating a system of a hearing aid device and a communication device, the hearing aid device having an acousto-electrical transducer, a signal processing device and an electro-acoustic transducer, the communication device having a controller and an electro-acoustic transducer, which comprises the steps of:

receiving an incoming call via the communication device;

signaling reception of the incoming call by the communication device outputting a first acoustic signal via the electro-acoustic transducer, the first acoustic signal carrying predetermined combinations or sequences of acoustic signals, and the first acoustic signal at least one of: laying outside a frequency range perceptible by a wearer, or being filtered out by the signal processing device;

receiving the first acoustic signal by the acousto-electrical transducer of the hearing aid device;

identifying the first acoustic signal in the hearing aid device;

carrying out of a first change of adjustment on the hearing aid device when the first acoustic signal has been identified;

subsequent to the identifying step, determining a distance between the communication device and the hearing aid via a sensor integrated in the communication device, the communication device determining the distance without assistance from the hearing aid device; and forwarding a distance signal containing the distance from the communication device to the hearing aid device.

2. The method according to claim 1, which further comprises transmitting, via the communication device, the first acoustic signal when the incoming call is accepted on the communication device.

3. The method according to claim 1, wherein the first acoustic signal is part of a ringing sound.

4. The method according to claim 1, wherein:

the first change of adjustment specifies a change in state of the hearing aid device into a first operating state and the hearing aid device, in the first operating state, monitors an environment of the hearing aid device for the distance signal from the communication device.

5. The method according to claim 4, wherein the hearing aid device performs a second change of adjustment on determining an approach of the communication device.

6. The method according to claim 5, wherein the hearing aid device cancels the second change of adjustment or performs a third change of adjustment when a removal of the communication device from the environment of the hearing aid device is determined.

7. The method according to claim 4, wherein the hearing aid device has a facility for detecting the distance signal of the communication device.

8. The method according to claim 6, wherein the hearing aid device cancels the first change of adjustment or performs a fourth change of adjustment when a second acoustic signal is received from the communication device so that the hearing aid device leaves the first operating state.

9. A hearing aid device, comprising:

an acousto-electrical transducer;

a signal processor;

an electro-acoustic transducer; and means for detecting a distance signal indicating a distance of a communication device relative to the hearing aid device;

the hearing aid device configured:

to receive a first acoustic signal through said acousto-electrical transducer, the first acoustic signal carrying predetermined combinations or sequences of acoustic signals, and the first acoustic signal at least one of: laying outside a frequency range perceptible by a wearer, or being filtered out by the signal processing device; and to identify the first acoustic signal and to carry out a first change of adjustment when the first acoustic signal has been identified, the first change of adjustment specifies a change in state of the hearing aid device into a first operating state and the hearing aid device is configured, in the first operating state, subsequent to identifying the first acoustic signal, to monitor an environment of the hearing aid device for an approach of the communication device with an aid of the distance signal.

10. The hearing aid device according to claim 9, wherein the hearing aid device is configured to perform a second change of adjustment on detection of the approach of the communication device.

11. The hearing aid device according to claim 10, wherein the hearing aid device is configured to cancel the second change of adjustment or to perform a third change of adjustment when the hearing aid determines a removal of the communication device from the environment of the hearing aid device.

12. The hearing aid device according to claim 9, further comprising an estimating device for estimating a transfer function of a feedback path.

13. The hearing aid device according to claim 9, further comprising a facility for detecting the distance signal of the communication device.

14. The hearing aid device according to claim 11, wherein the hearing aid device is configured to cancel the first change of adjustment or to perform a fourth change of adjustment when a second acoustic signal is received so that the hearing aid device leaves the first operating state.

15. A method for operating a system of a hearing aid device and a communication device, the hearing aid device having an acousto-electrical transducer, a signal processing device and an electro-acoustic transducer, the communication device having a controller and an electro-acoustic transducer, which comprises the steps of:

receiving an incoming call via the communication device;

signaling reception of the incoming call by the communication device outputting a first acoustic signal via the electro-acoustic transducer, the first acoustic signal being a combination of a predetermined first item of information modulated on an acoustic carrier frequency, and the first acoustic signal at least one of: laying outside a frequency range perceptible by a wearer, or being filtered out by the signal processing device;

receiving the first acoustic signal by the acousto-electrical transducer of the hearing aid device;

identifying the first acoustic signal in the hearing aid device;

carrying out of a first change of adjustment on the hearing aid device when the first acoustic signal has been identified; and subsequent to the identifying step, determining a distance between the communication device and the hearing aid via a sensor integrated in the communication device, the communication device determining the distance without assistance from the hearing aid device; and forwarding a distance signal containing the distance from the communication device to the hearing aid device.

16. The method according to claim 15, wherein the predetermined first item of information is a hearing-aid device-specific component.

17. The method according to claim 16, wherein the hearing-aid device-specific component is a serial number of communication device.

* * * * *